US006147288A

United States Patent [19]

Liao

[11] Patent Number: 6,147,288

[45] Date of Patent: Nov. 14, 2000

[54] PEDAL CLAMP

[76] Inventor: Tsun-Chi Liao, No. 14, Chun-Kung Rd., Taichung City, Taiwan

[21] Appl. No.: 09/460,523

[22] Filed: Dec. 14, 1999

[51] Int. Cl.[7] ..... G10D 13/02

[52] U.S. Cl. ..... 84/422.1; 84/422.2; 84/422.3

[58] Field of Search ..... 84/422.1, 422.2, 84/422.3

[56] References Cited

U.S. PATENT DOCUMENTS 5,185,489 2/1993 Hoshino ..... 84/422.1

*Primary Examiner*—David Martin
*Assistant Examiner*—Shih-yung Hsieh
*Attorney, Agent, or Firm*—Bacon & Thomas, PLLC

[57] ABSTRACT

A pedal clamp for fixing a pedal to a drum counterhoop mainly comprises a pedal base having a foot pedal with one end pivotally fixed and the other open and a beater. A clamp seat is formed at a front end of the pedal base, and an anchor body with a pivot hole is protrusively disposed in the clamp seat. A bolt set is used to penetrate the pivot hole to pivotally fix a clamp jaw at the anchor body. Two protrusive blocks are aligned along a centerline and secured to a support rod located behind the clamp seat. A clamp piece is arranged at a front end of the clamp jaw, an adjustment stud is fixed at those two protrusive blocks, and a brake sleeve clamps at a tail end of the adjustment stud. By abovesaid architecture, this invention provides an easy adjustment method between the pedal and the counterhoop without risking any harm to a drummer's fingers when adjusting that might occasionally happen in a conventional pedal clamp.

5 Claims, 7 Drawing Sheets

PEDAL CLAMP

BACKGROUND OF THE INVENTION

This invention relates generally to a drum pedal, more particularly, to an improved pedal structure that can be adjusted easily to regulate percussion force of a beater.

When playing a drum set, a drummer is supposed to tread his foot on a restorable drum pedal that in turn drives a beater to knock on a bass drum. A conventional pedal shown in FIG. 1 is pivotally disposed at a base by one end, the other free open end is connected with a beater and clamped to a counterhoop by a clamp set. The defect of such a pedal structure is that the clamp set is going gradually loosened because of vibration of the drumhead. If adjustment is desired, the drummer has to take a low posture by bending his waist to reach an adjustment screw in a limited space under the pedal that the drummer might hurt his own fingers in case of a careless tread on the pedal by his foot.

SUMMARY OF THE INVENTION

The primary object of this invention is to provide a simple structure for easy adjustment of a pedal clamp on a counterhoop and avoiding scratch during adjusting an adjustment stud in order to prolong lifetime of the pedal clamp.

For achieving abovesaid goals, this invention is to dispose a clamp seat at a front end of a pedal base, wherein an anchor body having a pivot hole is protrusively disposed in the clamp seat; a bolt set penetrates the pivot hole to pivotally fix a clamp jaw at the anchor body; two protrusive blocks having a through hole each are secured to a support rod behind the clamp seat of the pedal clamp; one end of the clamp jaw is pivotally fixed at the anchor body, the other is an open end; a clamp piece is protrusively arranged at the front end of the clamp jaw; and an adjustment stud is penetrably jointed with those two protrusive blocks, and a brake sleeve is disposed near the tail end of the adjustment stud.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
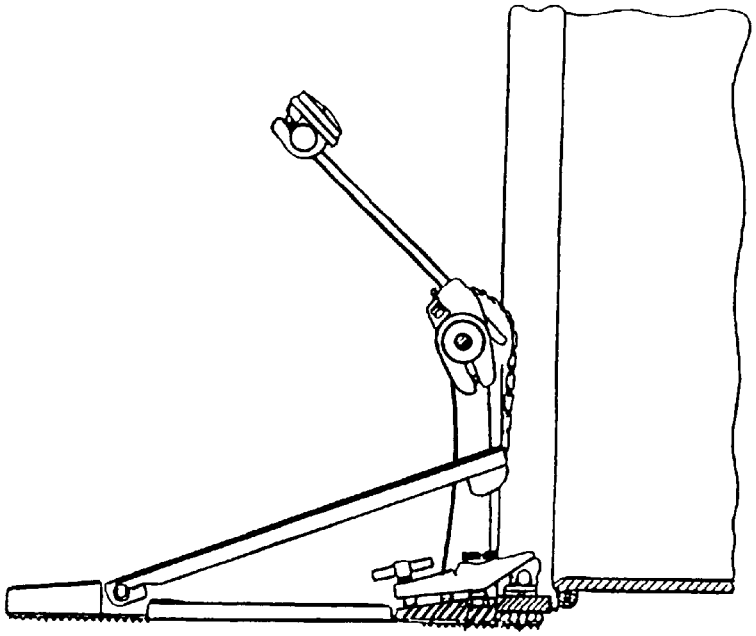
FIG. 1 PRIOR ART
FIG. 1 is a plan view of a conventional pedal base.
Figure 2:
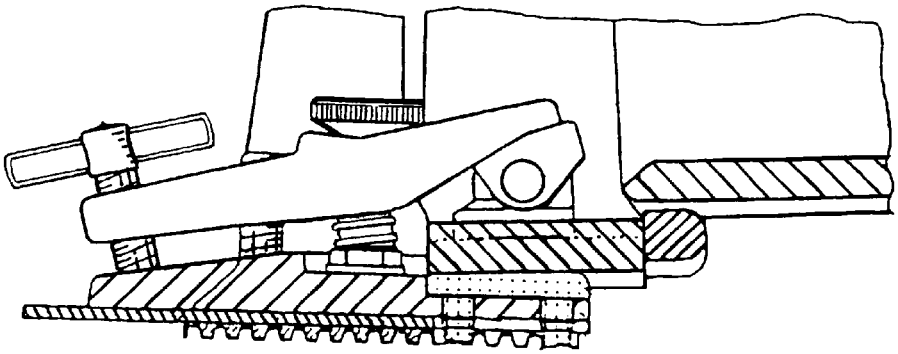
FIG. 2 PRIOR ART
FIG. 2 is a partially enlarged view of the conventional pedal set.
Figure 3:
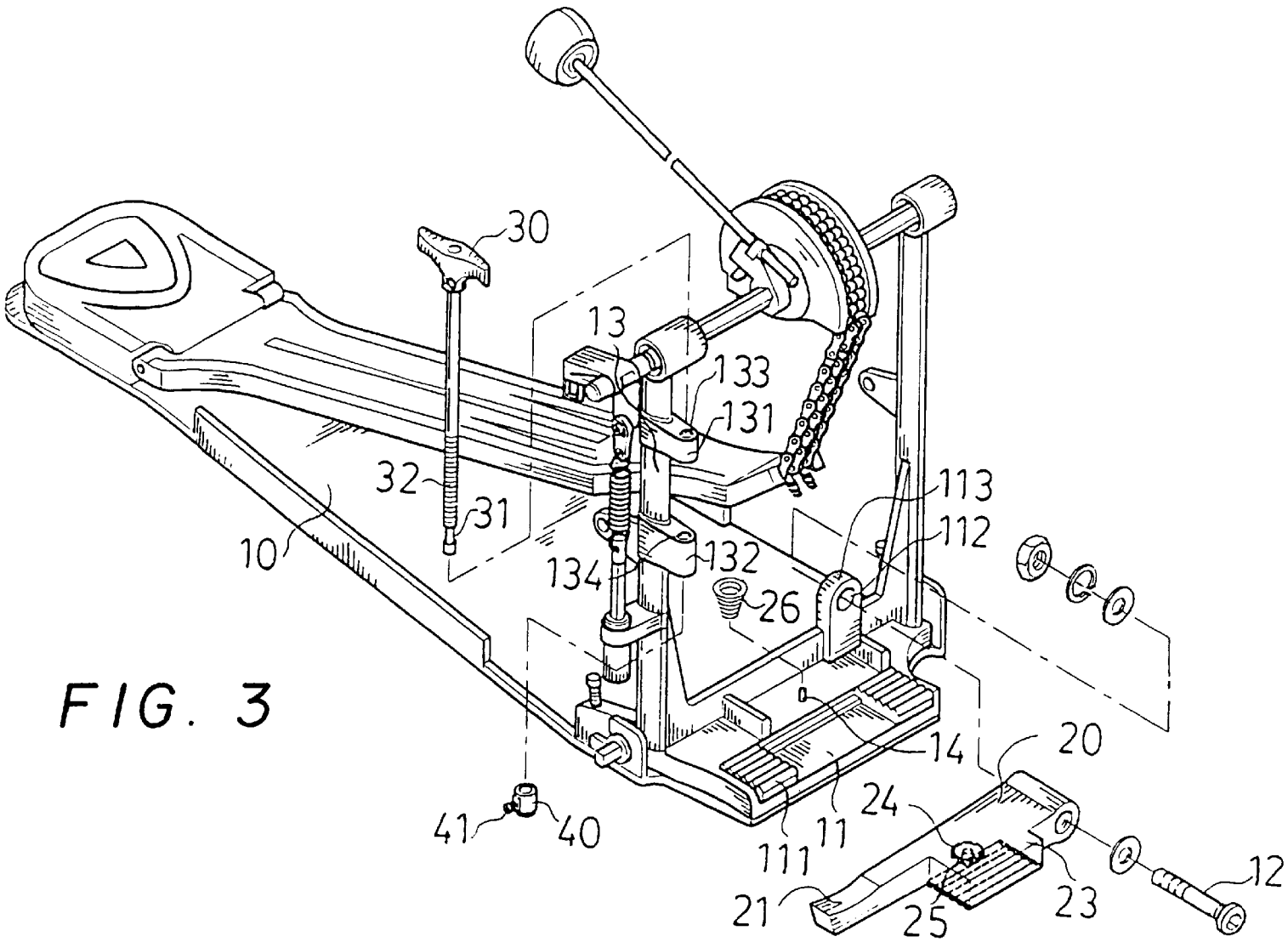
FIG. 3 is an exploded perspective view of this invention.
Figure 4:
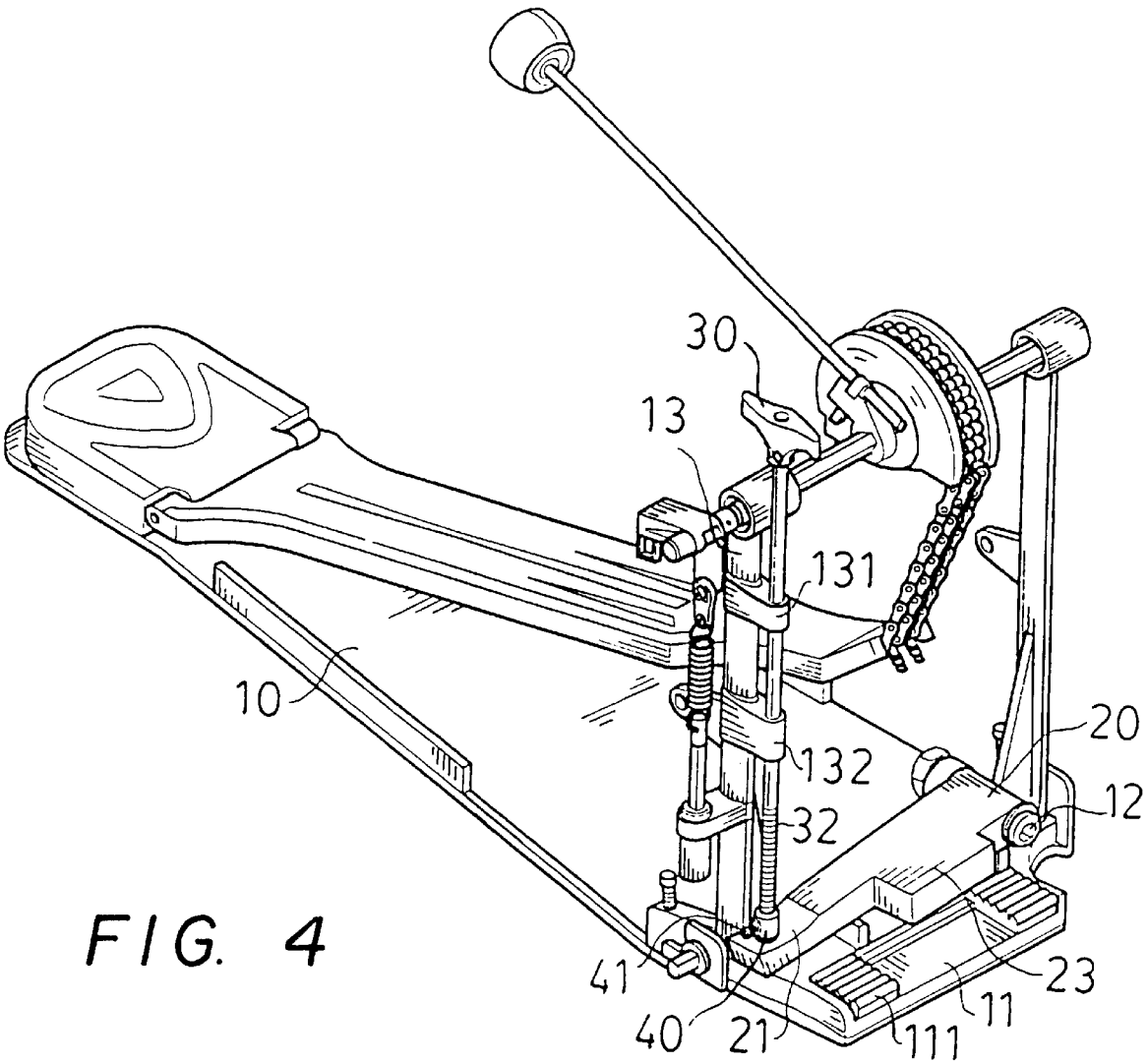
FIG. 4 is an assembled side elevational view of this invention.
Figure 5A:
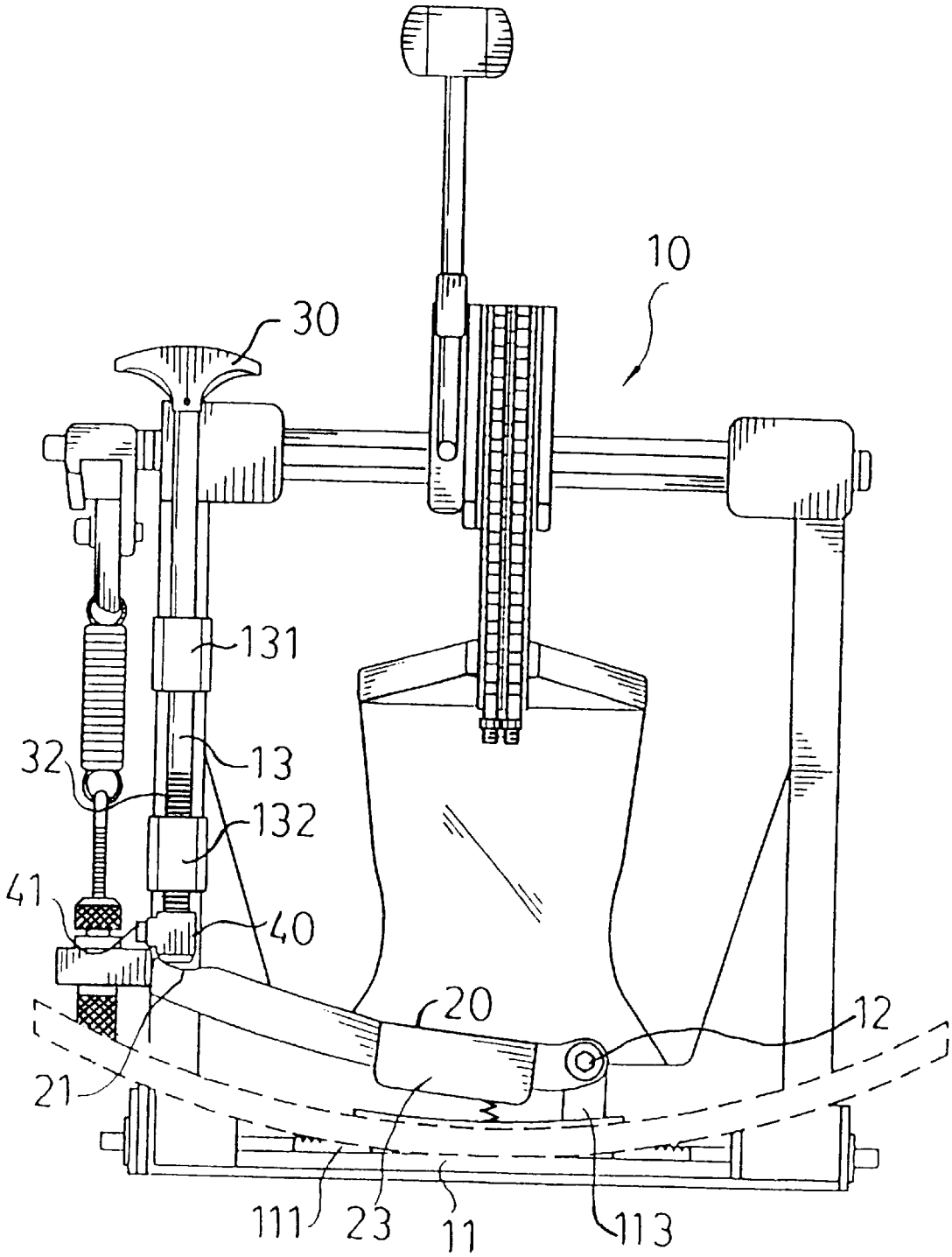
FIG. 5A is a front view of this invention.
Figure 5B:
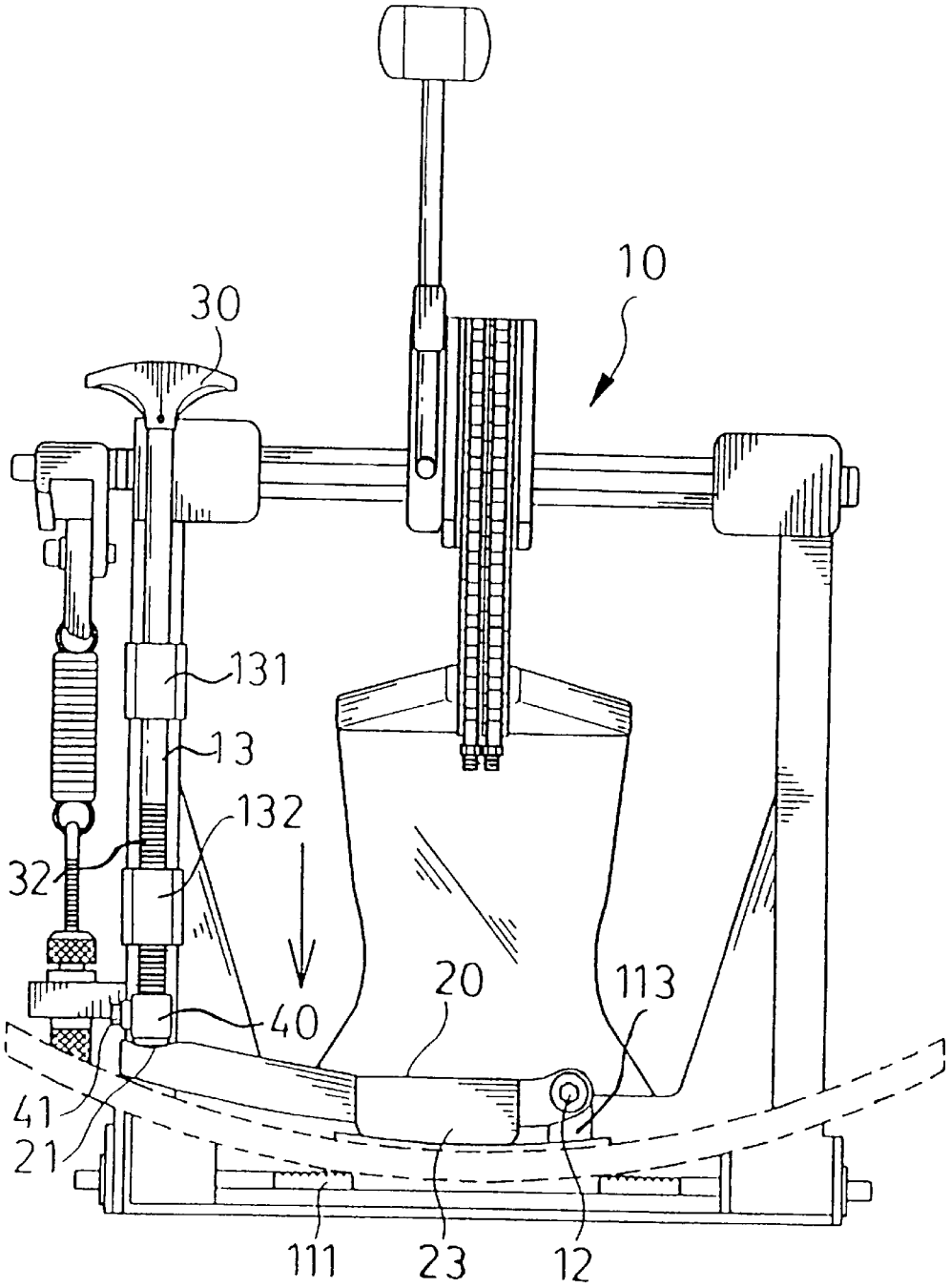
FIG. 5B shows action of this invention.
Figure 6A:
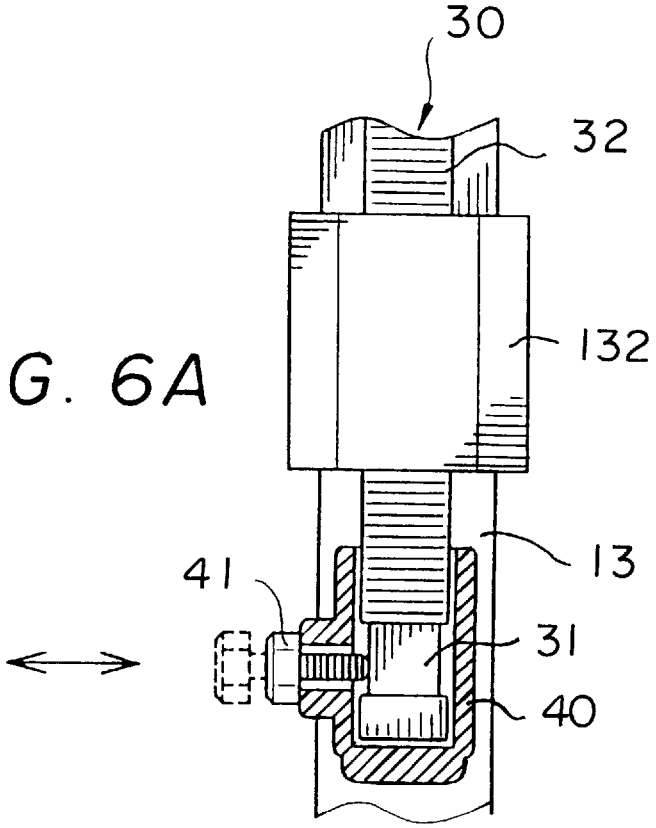
FIG. 6A is a partial cutaway sectional view of an adjustment stud and a brake sleeve of this invention.
Figure 6B:
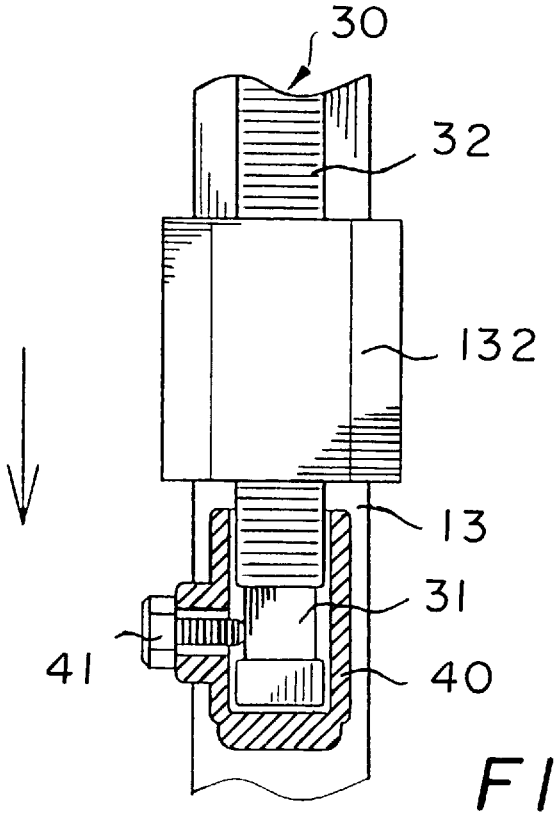
FIG. 6B shows action of FIG. 6A.
Figure 7A:
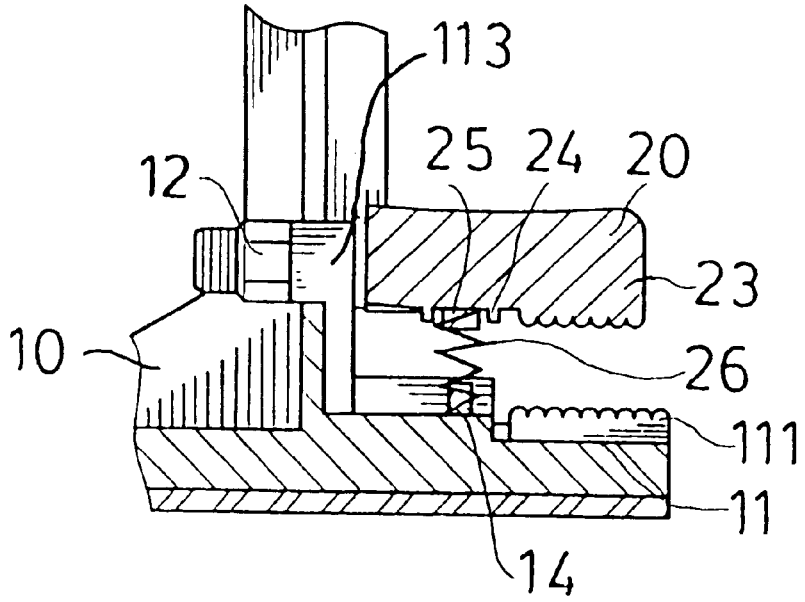
FIG. 7A is a partial cutaway sectional view of a clamp jaw and a spiral spring of this invention.
Figure 7B:
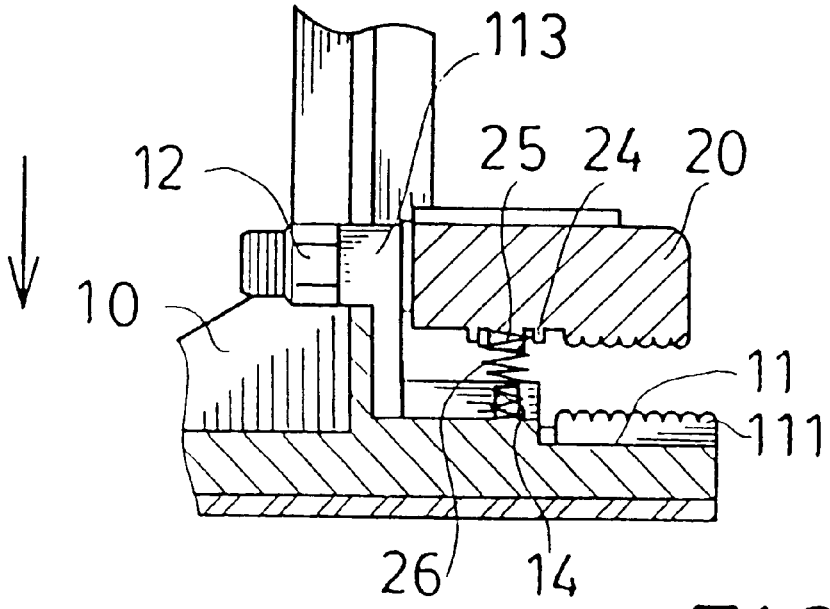
FIG. 7B shows action of FIG. 7A.

As shown in FIG. 3 through FIG. 7B, this invention mainly comprises a pedal base 10, a clamp jaw 20, an adjustment stud 30, and a brake sleeve 40.

The pedal base 10 further comprises a foot pedal and a beater, wherein one end of the foot pedal is open and the other end is pivotally jointed with the pedal base 10; a clamp seat 11 formed at a front end of the pedal base 10 is provided with a toothed mat 111 in a soft material on the clamp jaw 20 and the clamp seat 11 to ensure a solid grasp on a counterhoop of a bass drum in order not to hurt the counterhoop; an anchor body 113 having a pivot hole 112 is arranged in the upper jaw of the pedal base 11, and a bolt set 12 penetrates the pivot hole 112 for pivotally fixing a clamp piece 20 on the anchor body 113; a first and a second protrusive block 131, 132 are secured to a support rod 13 located behind the clamp seat 11 of the pedal base 10 and aligned along a centerline, wherein a through hole 133 and a tapped hole 134 are perforated centrally in the first and the second protrusive block 131, 132 respectively; and a pin 14 is protrusively disposed at a center portion of the clamp seat 11.

One end of the clamp jaw 20 is pivotally fixed at the anchor body 113 by the bolt set 12 while the other is an open end 21 so that the clamp jaw 20 can take the anchor body 113 as its center to sway up and down. A clamp piece 23 protrusively disposed at the front end of the clamp jaw 20 is provided with teeth on its bottom face in order to clamp tightly. A circular flange 24 is also formed on the bottom face of the clamp jaw 20, wherein a pin 25 is protrusively located in the flange 24 in cooperation with the flange 24 for fixedly inserting a spiral spring 26 which is reversely disposed on the pin 14 of the clamp seat 11.

The adjustment stud 30 is pivotally mounted on the protrusive block 131, 132 of the support rod 13, wherein a circular recess 31 is positioned near the tail end of the adjustment stud 30, and an outer thread 32 is formed above the circular recess 31 for screw-fixing the second protrusive block 132.

The brake sleeve 40 having an upward opening is collared underneath the adjustment stud 30, wherein a positioning bolt 41 penetrates the wall of the brake sleeve 40 and reaches the circular recess 31 so that the brake sleeve 40 is fixedly positioned to prevent the adjustment stud 30 from loosening owing to vibration.

The assembling process is to have the adjustment stud 30 penetrated through the protrusive blocks 131, 132 of the support rod 13, and collar the brake sleeve 40 at the tail end of the adjustment stud 30, then, screw one end of the clamp jaw 20 fixedly to the anchor body 113 of the pedal base 10 with the bolt set 12 in the manner that the other end of the clamp jaw 20 is located exactly underneath the second protrusive block 132 of the support rod 13 to form a lever structure so that the spiral spring 26 can restore the clamp jaw 20 back to its normal position when an external force is released.

Put a counterhoop of a bass drum between the clamp jaw 20 and the clamp seat 11, then, screw the adjustment stud 30 downward through abovesaid through hole 133 and tapped hole 134 of the protrusive blocks 131, 132. As the head of the adjustment stud 30 is higher than that of the support rod 13, it is easy and safe to adjust without danger of pinching a drummer's own finger as mentioned above in a conventional pedal.

The merits of this invention may be summarized as the following:

When the adjustment stud 30 is screwed downward, the brake sleeve 40 will descend meanwhile to press down the open end 21 of the clamp jaw 20, however, as the brake sleeve 40 is fixed in the circular recess 31 by the positioning bolt 41, it won't rotate when descending. Hence, the adjustment stud 30 presses the clamp jaw 20 indirectly without scratching the latter and a uniform pressure is obtainable.

As the exerting force arm from the open end 21 of the clamp jaw 20 to the anchor body 113 is longer than the resistant force arm from the clamp piece 23 to the anchor body 113, a slight adjustment of the adjustment stud 30 will create an enlarged force to the clamp piece 23.

When the clamp piece 23 is pressed down to cooperate with the clamp seat 11, the counterhoop can be bitten tightly by taking advantage of teeth on the bottom face of the clamp piece 23 and on the mat 111 of the clamp seat 11.

Moreover, when releasing the counterhoop is desired, all the drummer has to do is turn the adjustment stud 30 reversely, then the brake sleeve 40 will ascend upward and the spiral spring 26 will stretch to push the clamp piece 23 upward rapidly. And because of the lever principle, the pressure on the spiral spring 26 is lesser than that on the open end 21, hence, when the pressure on the clamp jaw 20 is removed, it can move upward immediately in virtue of the restoring force of the spiral spring 26.

Although, this invention has been described in terms of preferred embodiments, it is apparent that numerous variations and modifications may be made without departing from the true spirit and scope thereof, as set forth in the following claims.

What is claimed is:

1. A pedal clamp for fixing a pedal to a counterhoop, comprising:

a pedal base having a foot pedal with one end pivotally fixed and the other open and a beater, wherein a clamp seat is formed at a front end of said pedal base; a toothed mat made of a soft material is disposed on both sides of said clamp seat respectively for tight clamping to a counterhoop without doing any harm; an anchor body with a pivot hole is arranged in said clamp seat, wherein a bolt set penetrates said pivot hole for fixing a clamp jaw at said anchor body; a first and a second protrusive blocks are aligned in a centerline and secured to a support rod located behind said clamp seat, wherein a through hole and a tapped hole are formed in said first and said second protrusive blocks respectively; and a pin is centered and protruded upwards on said clamp seat;

a clamp piece disposed protrusively at front end of said clamp jaw which is pivotally fixed at said anchor body by said bolt set; and an adjustment stud penetrated and being fixed to said protrusive blocks, wherein a circular recess is formed at a position near a tail end of said adjustment stud, and an outer thread is formed above said circular recess for screw-fixing in said tapped hole of said second protrusive block;

wherein said adjustment stud is located at a higher position than said support rod, a drummer being capable of regulating said adjustment stud easily to clamp said clamp jaw and said clamp seat at a drum counterhoop without risking hurt to his fingers that might occasionally happen in the case of a conventional pedal clamp.

2. The pedal clamp for fixing a pedal to a counterhoop of claim 1, wherein one end of said clamp jaw is pivotally fixed at said anchor body by said bolt set while the other is an open end so that said clamp jaw can take said anchor body as a center point to sway up and down; and when an open end of said clamp jaw is pressed downward by a brake sleeve with a slight turning of said adjustment stud, as the lever principle reveals, an enlarged force will exert on said clamp piece because the exerting force arm extended from said anchor body to said open end is longer than the resistant force arm extended from said anchor body to said clamp piece.

3. The pedal clamp for fixing a pedal to a counterhoop of claim 1, wherein teeth is formed on a bottom face of said clamp piece and on said mat of said clamp seat for enhancing occlusion on the drum counterhoop.

4. The pedal clamp for fixing a pedal to a counterhoop of claim 1, wherein a circular flange and a pin located protrusively therein are disposed on a bottom face of said clamp jaw, and a spiral spring is fixed reversely on the pin of said clamp seat; and no sooner than the drum counterhoop has been released from this invention, said spiral spring pushes said clamp piece upwards.

5. The pedal clamp for fixing a pedal to a counterhoop of claim 1, wherein a facing upward brake sleeve envelops the tail end of said adjustment stud, and the circumference of said brake sleeve is perforated to allow penetration of a positioning bolt for fixing said brake sleeve around said circular recess to prevent it from escaping and also said adjustment stud from loosening because of vibration; and said brake sleeve will not rotate following said adjustment stud so that any scratch on said clamp jaw will not be incurred by said adjustment stud, and a uniform pressure is obtainable.

* * * * *